US005918829A

United States Patent [19]

Fäh

[11] Patent Number: 5,918,829

[45] Date of Patent: Jul. 6, 1999

[54] APPARATUS FOR WINDING A THREAD ONTO A BOBBIN

[75] Inventor: Theo Fäh, Oberschan, Switzerland

[73] Assignee: Schärer Schweiter Mettler AG, Horgen, Switzerland

[21] Appl. No.: 08/931,607

[22] Filed: Sep. 16, 1997

[30] Foreign Application Priority Data

Sep. 16, 1996 [EP] European Pat. Off. ..... 96114792

[51] Int. Cl.[6] ..... B65H 54/28

[52] U.S. Cl. ..... 242/481.4; 242/478.2

[58] Field of Search ..... 242/481.3, 481.4, 242/481.5, 481.6, 481.7, 470, 476.7, 478.2

[56] References Cited

U.S. PATENT DOCUMENTS

| | | | |
|---|---|---|---|
| 3,615,060 | 10/1971 | Jenny | 242/470 |
| 3,796,383 | 3/1974 | Sartori | 242/470 |
| 4,198,871 | 4/1980 | Dunn et al. . | |
| 4,653,948 | 3/1987 | Ikeda | 400/335 |
| 5,639,037 | 6/1997 | Marangone et al. | 242/478.2 X |
| 5,772,137 | 6/1998 | Gilbos et al. | 242/470 |

FOREIGN PATENT DOCUMENTS

| | | |
|---|---|---|
| 0302461 | 2/1989 | European Pat. Off. . |
| 0453622 | 10/1991 | European Pat. Off. . |
| 8915275 | 3/1990 | Germany . |
| 58221053 | 12/1983 | Japan . |
| 4203548 | 7/1992 | Japan . |

OTHER PUBLICATIONS

Sales brochure published by Schärer Schweiter Mettler AG summarizing the subject matter of EP 0 453 622, pp. 1–4.

*Primary Examiner*—Michael Mansen
*Attorney, Agent, or Firm*—Baker & Botts, L.L.P.

[57] ABSTRACT

An apparatus for winding a thread onto a bobbin having a traversing element susceptible to tension variations and a thread guide for executing a traversing motion along the longitudinal direction of the bobbin. The thread guide is connected to the traversing element, which is operated by a plurality of guiding elements and a drive wheel arranged to function as a pre-loading element. By virtue of the drive wheel functioning as a pre-loading element, tension variations in the traversing element are absorbed when the direction of the traversing element is reversed. This allows the winding apparatus to achieve very high traversing speeds and thread guide positioning accuracies.

13 Claims, 3 Drawing Sheets

APPARATUS FOR WINDING A THREAD ONTO A BOBBIN

BACKGROUND OF THE INVENTION

The present invention relates to an apparatus for winding a thread onto a bobbin comprising a thread guide connected to a traversing element, a motor-actuated drive wheel and guiding elements for guiding the traversing element along a longitudinal direction of the bobbin, and a sensor for monitoring the traversing motion of the thread guide.

Due to the high accelerations and decelerations of the traversing element, said element is to have as low a mass as possible and therefore preferably takes the form of a flexible member, albeit rigid in traversing direction for transmitting tensile forces. Suitable, known traversing elements are, for example, strings, wires, cables, bands or belts.

In a winding apparatus of said type described in EP-A-0 453 622, in which the traversing element is formed by a string, guide pulleys and the string are disposed rigidly on a common carrier plate. Upon each reversal of motion of the thread guide and hence of the string, one of the two strands of the string running from the thread guide via the guide pulley to the drive wheel is tightened and the other is slackened, thereby impairing the positioning accuracy of the thread guide and limiting the traversing speed.

An object of the invention is therefore to provide a winding apparatus in which tension variations in the traversing element formed by a flexible member, e.g., a string, belt, cable, band or the like, are substantially eliminated in the region of the reversing points such that very high traversing speeds and very high thread guide positioning accuracies are achieved.

SUMMARY OF THE INVENTION

According to the invention, the traversing element is guided by means of a pre-loading element spring-mounted at right angles thereto for minimizing the effects of tension variations.

By virtue of the pre-loading element according to the invention, the tension variations in the traversing element are substantially eliminated so that it is possible to achieve a far higher traversing speed and, in particular, a far higher reversing acceleration. Since the tension variations of the traversing element are absorbed by the pre-loading element, the tightening and slackening of the traversing element which impairs the positioning accuracy of the thread guide is substantially eliminated.

In a one aspect of the present invention, the winding apparatus is characterized by a traversing element formed by a cable, a string or a belt, and wherein a pre-loading element is formed by the drive wheel. Designing the drive wheel as a pre-loading element not only offers the advantage of making an additional element for the pre-loading element redundant but also enables optimum compensation of the tension variations of the traversing element.

A further aspect of the winding apparatus according to the present invention is characterized by a plurality of guiding elements mounted in a fixed manner on a common carrier, and a tongue-like bracket with bending structures for supporting the drive wheel. In addition, both strands of the traversing element—one running via one guide pulley and the other running via another guide pulley—are wrapped around the drive wheel so that the drive wheel acts upon both strands simultaneously. The mounting of the drive wheel on the tongue-like bracket connected to the carrier by the bending structures has the advantage that it is possible, by suitably dimensioning and designing the bending structures, to achieve an optimum dynamic characteristic of the pre-loading element for a particular machine configuration.

Another aspect of the present invention is characterized in that a base plate is provided, which is connected preferably with screws, to the carrier and on which the bending structures act, and that the bracket at one edge is supported by the bending structures and at the other edges is free.

Yet another aspect of the present invention is characterized by a base plate having two oppositely directed U-shaped recesses, each embracing the other such that the inner recess separates the bracket from the bending structures and the outer recess separates the bending structures from the base plate, and such that the bending structures extend between the longitudinal limbs of the U- shaped recesses from the bracket to the base plate.

The winding apparatus according to the present invention is further characterized by the presence of a sensor for monitoring the traversing motion of the thread guide. The sensor monitors scan markings on a rotating member coupled to the thread guide. The rotating member is preferably formed by the drive wheel or by a disc rigidly connected to the drive wheel.

The sensor design according to the invention has the advantage that the sensor, from the number of markings, always knows the precise position of the thread guide so that the drive motor may be adjusted by a control module always to the rotational speed corresponding to the relevant position. Thus, the output of the drive motor which is formed by a stepping motor may be almost fully utilized.

BRIEF DESCRIPTION OF THE DRAWINGS

For a complete understanding of the present invention and the advantages thereof, reference is now made to the following description taken in conjunction with the accompanying drawings in which like reference numbers indicate like features and wherein.

DETAILED DESCRIPTION OF THE INVENTION

Figure 1:
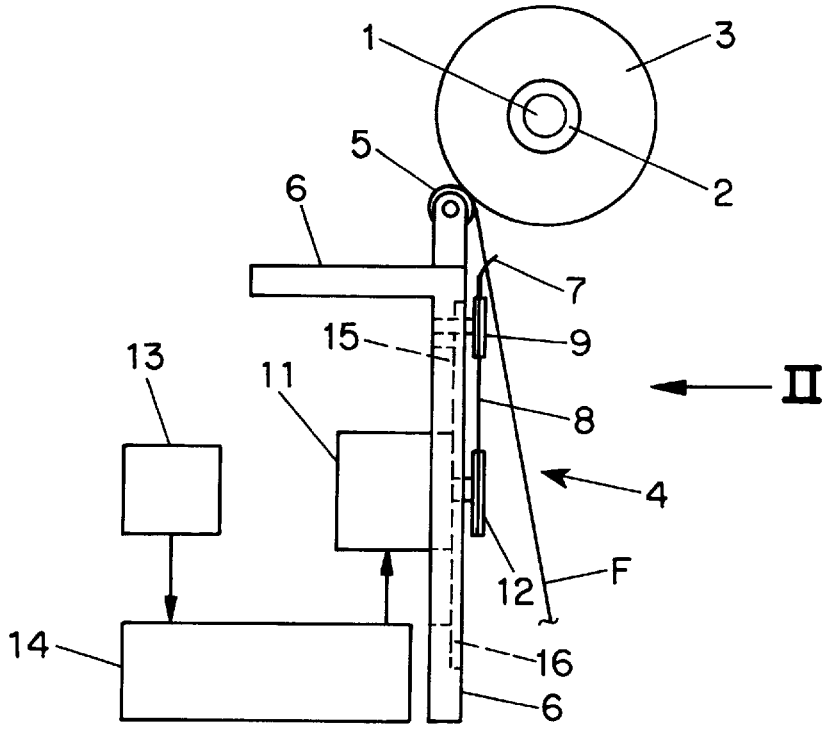
FIGS. 1 and 1A illustrate a side view of an apparatus for winding a thread onto a bobbin according to a preferred embodiment of the present invention.

The winding head shown in FIG. 1 substantially comprises a motor-actuated spindle 1 for receiving and supporting a bobbin case 2, onto which a bobbin 3, e.g. a cross-wound bobbin, is wound, and a winding apparatus 4 for a thread F which is drawn off a supply coil by feeder rolls (not shown). The bobbin 3 rests along a surface line against a freely rotatable roller 5 which is mounted on a suitable carrier 6. The winding apparatus 4 used to produce the desired winding has, as its central element, a thread guide 7 which executes an oscillating traversing motion along the axis of the bobbin 3, i.e., at right angles to the drawing plane of FIG. 1.

Figure 2:
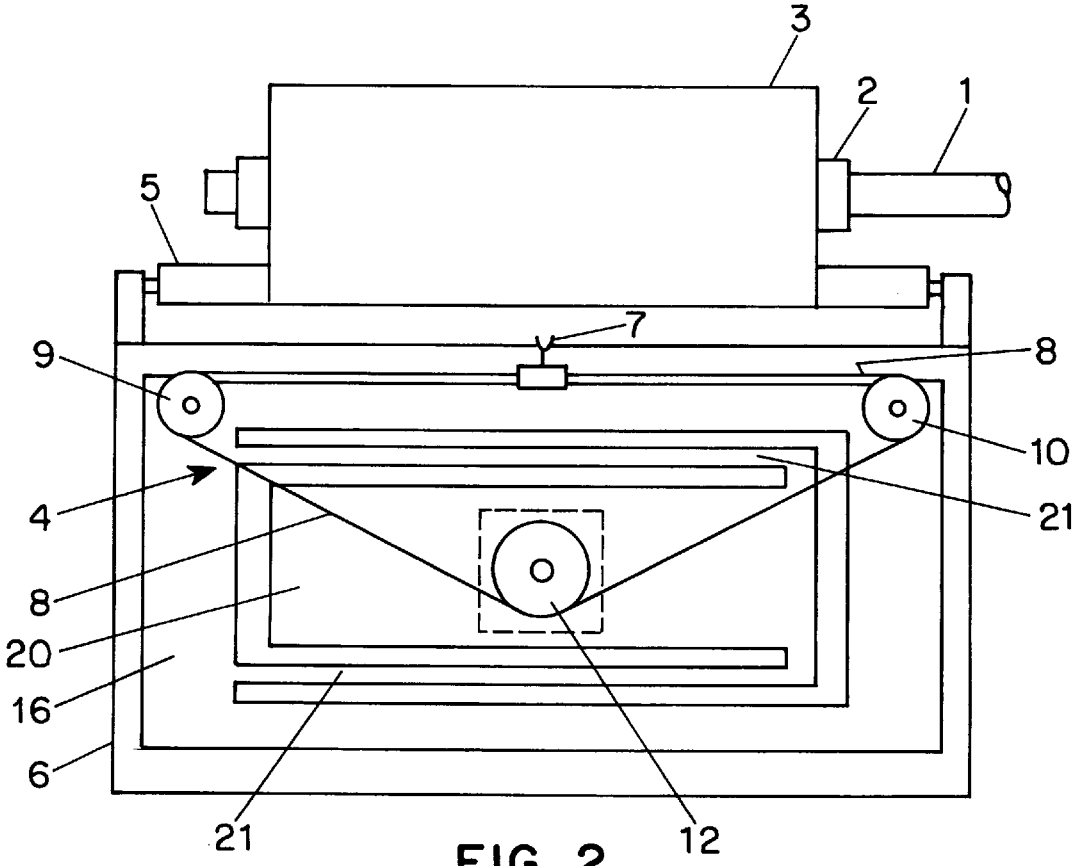
FIGS. 2 and 2A illustrate a front view (in the direction of the arrow II) of FIG. 1 and the drive wheel configuration, respectively.
Figure 2A:
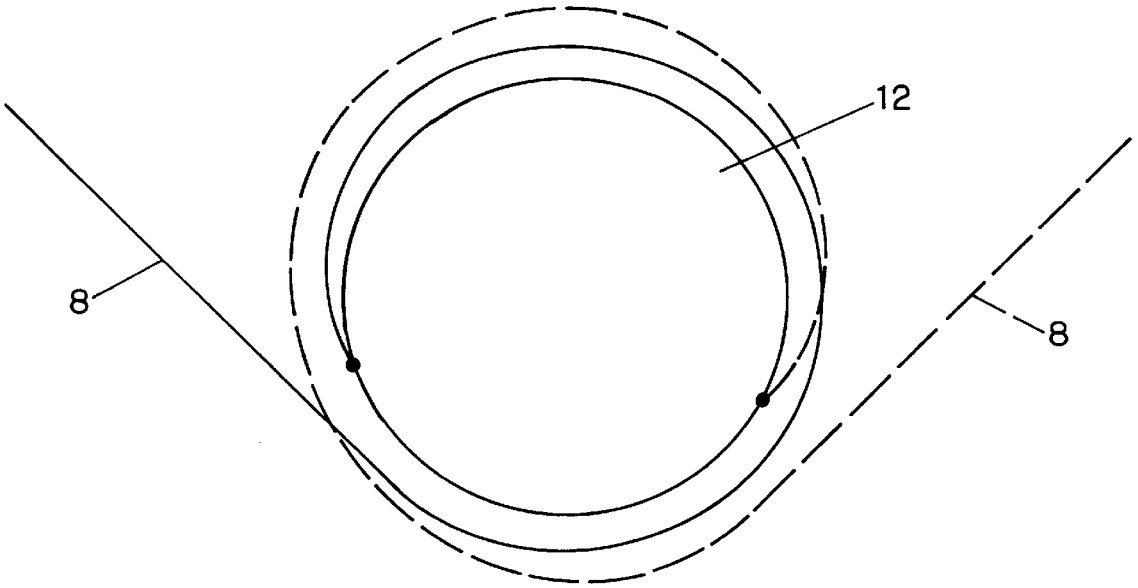

According to FIG. 2, the thread guide 7 is fastened on a traversing element 8. The traversing element 8 is a flexible member but rigid in the traversing direction for transmitting tensile forces and is formed, for example, by a string, wire, metal cable, flat belt, toothed belt or V-belt, metal band, chain or the like. The traversing element 8 runs through a plurality of guiding elements, shown by guide pulleys 9 and 10 by way of example and not limitation, which are rigidly supported on the carrier 6 to a drive wheel 12 actuated by a motor 11, preferably a stepping motor. As shown in FIG. 2A, the ends of the traversing element 8 are wrapped a plurality of turns around the drive wheel and fastened to the drive wheel. When the drive wheel 12 is driven, depending on its direction of rotation, the thread guide 7 is moved towards one of the guide pulleys 9 or 10. The distance between the guide pulleys 9 and 10 indicates the maximum possible travel of the thread guide 7 during its traversing motion. For optimum efficiency, the drive wheel 12 is adapted to the torque characteristic of the motor 11 and to the load formed by thread guide 7, thread F and traversing element 8.

Figure 1A:
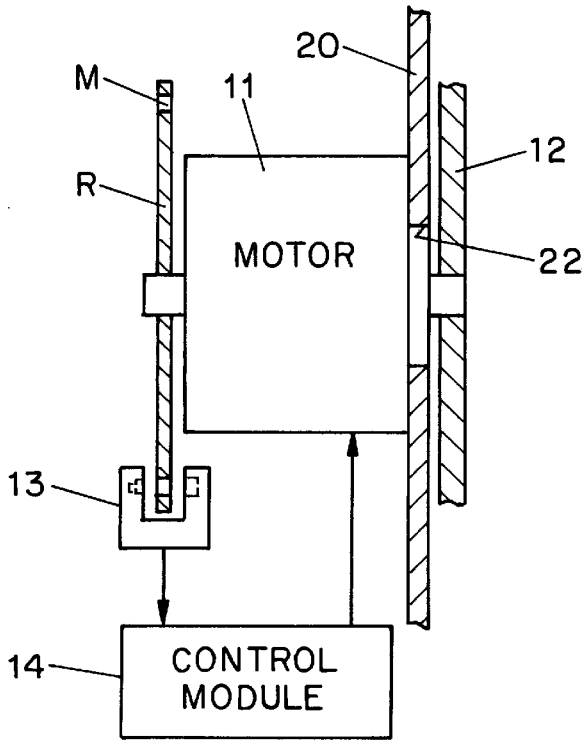

Associated with the motor 11 is a sensor 13 for detecting the rotary position of the drive wheel 12 and hence the traversing position of the thread guide 7. In a preferred embodiment of the present invention as shown in FIG. 1A, the winding apparatus 4 further comprises a rotating member R coupled via the drive wheel 12 to the thread guide 7, and a plurality of scan markings M located on the rotating member, whereby the sensor 13 detects the scan markings located on the rotating member R. In another preferred embodiment of the present invention, the rotating member R is formed by the drive wheel 12, whereby the sensor 13 detects scan markings located on the rotating member drive wheel 12 itself.

Referring again to FIG. 1A, the sensor 13 can be a photo-electric sensor utilizing a transmitting and receiving diode for scanning the motion of a disc, i.e., the rotating member R, (not shown) rigidly connected to the drive wheel 12. Accordingly, the disc is provided with suitable optically scannable markings, e.g., holes or slots arranged in a circular pattern as shown in FIG. 1A. Preferably, the disc is a perforated disc rigidly connected to the drive wheel 12.

Next, a sensor signal is provided to a control module 14, which determines whether the motor 11 is operating at the speed intended for the respective position of the thread guide 7. If the control module 14 determines a difference between actual and expected values, the control module 14 passes a corresponding control signal to the motor 11. The number of markings on the disc and their dimension are selected to indicate, for the travel of the thread guide 7, approximately 1500 positions of the thread guide 7 which may be checked by the sensor 13.

Scanning of the disc provided with the markings enables a complete monitoring of the entire traversing motion of the thread guide 7, which is not readily accomplished with a conventional sensor arrangement along the path of the thread guide 7. With a conventional sensor arrangement, monitoring of the thread guide 7 is limited to a specific range of positions, and not the entire range of motion of the thread guide 7. In addition, the motor 11 must be monitored in order to determine whether the motor has skipped a step. Because a conventional sensor arrangement only provides an approximate position of the thread guide, the operation of the motor 11 must also be limited by a safety margin to avoid operating the motor 11 at or above its operational limits.

In the sensor arrangement according the present invention, the sensor 13 monitors the position of the thread guide 7 with respect to the initial position of the thread guide 7, preferably with respect to a zero point of its traversing motion. The sensor 13 is calibrated by moving the thread guide 7 to one reversing point, and then to the other reversing point. As the thread guide is moved from one reversing point to the other, the sensor 13 counts the number of markings corresponding to the distance between the reversing points and the zero point. The sensor 13 therefore knows the number of scanning pulses between the zero point and the reversing points. On the basis of the scanning pulses, it is therefore possible at any time to determine the position of the thread guide 7. This in turn enables extremely precise control of the motor 11 and allows the output of the motor 11 to be fully utilized.

The carrier 6 of the winding apparatus 4 has a substantially rectangular opening 15 which is covered, in the direction of the thread F, by a base plate 16. The base plate 16, as shown in more detail FIG. 3, has at its longitudinal edges a plurality of holes 17 for receiving fastening screws and is attached in the region of said holes to the edge of the opening 15. Two further holes provided with the reference numeral 18 are used for passage of the axles of the guide pulleys 9 and 10, which axles are supported in the carrier 6.

Referring again to FIG. 3, the base plate 16 of the present invention thus comprises a frame-like edge region 19 and a tongue-shaped bracket 20, which is connected to the edge region 19 of the base plate 16 at a first transverse edge 27, and suspended freely at a second transverse edge 28. The connection between the bracket 20 and edge region 19 is effected by means of the bending structures 21, which extend from the first transverse edge 27 of the bracket 20 at a distance from and parallel to the longitudinal edges of the bracket 20. The bending structures 21, lying within the gap formed by the longitudinal limbs 29 and 31 of the U-shaped recesses, extend between the bracket 20 and edge region 19 up to the opposite second transverse edge 28 of the edge region 19.

Figure 3:
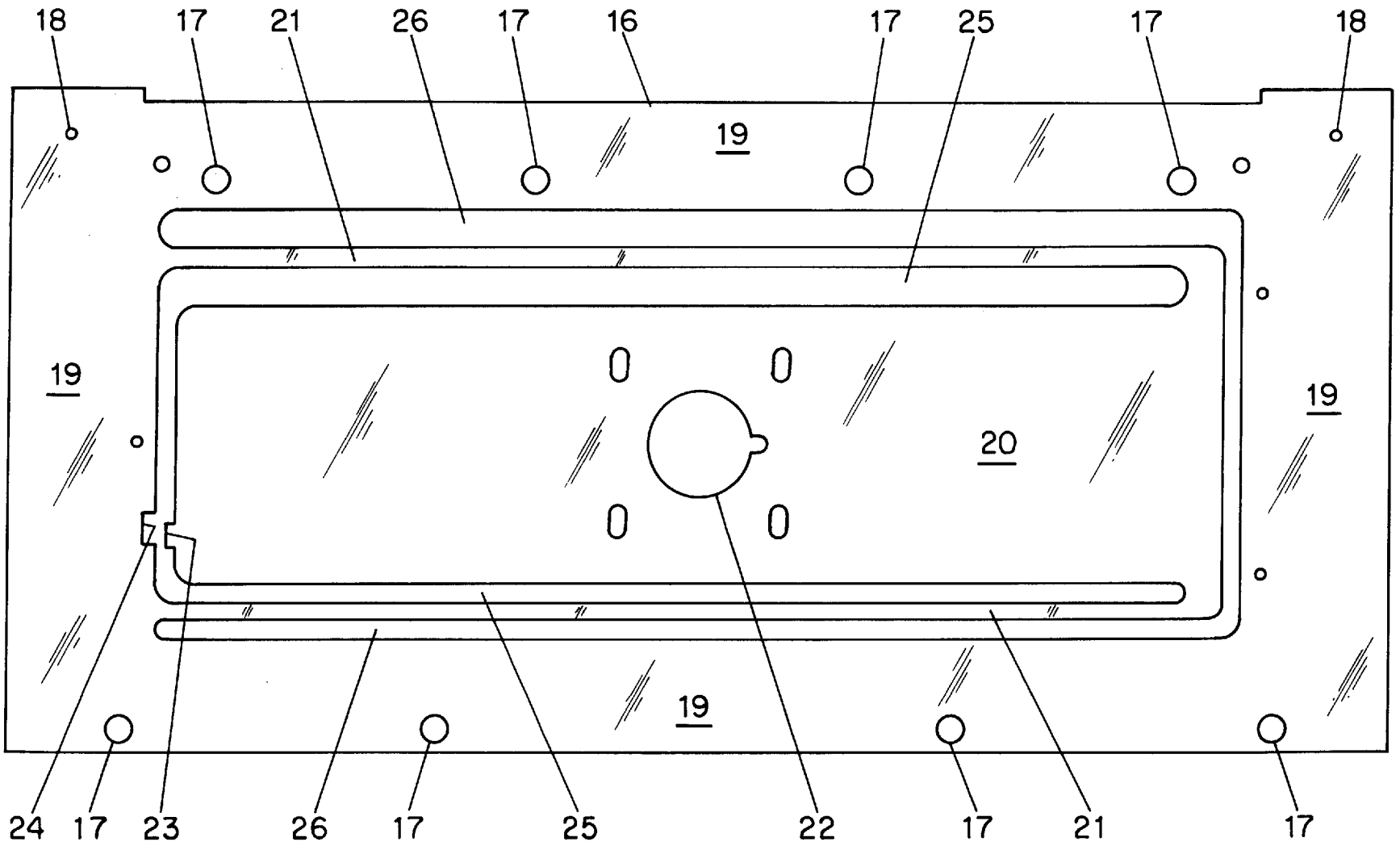
FIG. 3 illustrates a detailed front view of the base plate shown in FIG. 2.

The arrangement of the bending structures 21 as shown in FIG. 3 gives the appearance of two oppositely directed U-shaped recesses 25 and 26 inserted one into the other, whereby the inner U-shaped recess 25 separates the bracket 20 from the bending structures 21, and the outer U-shaped recess 26 separates the bending structures 21 from the base plate 16. The bracket 20 therefore exhibits spring-like characteristics due to the configuration of the bending structures 21 and the edge region 19. When subject to large enough forces, the bracket 20 is adjustable in the direction at right angles to the longitudinal edges of the base plate 16.

The hole 22 in the middle of the bracket 20 provides a means for mounting a non-rotating portion of the motor 11 (FIG. 1) to the bracket 20. The motor 11 is fastened to the rear side of the bracket 20 so that the drive wheel 12 projects in a forward direction from the hole 22. The portion of the motor 11 held in place by the hole 22 is designed such that there is an optimum heat transfer from the motor 11 to the bracket 20. Thus, the bracket 20 also acts as a cooling surface for the motor 11.

The drive wheel 12, for guiding the turns of the traversing element 8, has a groove (not shown) in the manner of a thread, the turns of which have an inclination relative to the plane defined by the guide pulleys 9, 10 and the drive wheel 12 which corresponds to the pitch. To prevent the traversing element 8, as it runs in and out of the groove, from rubbing against its side walls and becoming worn as a result, the drive wheel 12 is disposed in a slightly inclined manner so that the turns of the groove in the region where the traversing element 8 runs towards and away from the drive wheel 12 lies parallel to the traversing element 8. The inclined arrangement of the drive wheel 12 is achieved in that the bracket 20, which carries the motor 11, in its longitudinal direction is arranged at an angle of several degrees relative to the base plate 16, which is easily achieved by suitable bearing means between base plate 16 and the transverse edges 27 and 28 of the bracket 20.

The spring action of the bracket 20 is used to compensate for tension variations in the traversing element 8, preferably formed by a steel cable, in the region of where the thread guide's 7 motion arrives at a reversing point. At the reversal point, the two strands of the traversing element 8 which are connected to the thread guide behave differently. During deceleration, the strand leading in the direction of motion is slackened and the trailing strand is tightened. During acceleration, the leading strand is tightened and the trailing strand is slackened.

The dynamic behavior of the traversing element 8 limits the positioning accuracy of the thread guide 7 at a given acceleration or deceleration, and hence limits the traversing speed of the thread guide 7 given a preset positioning accuracy of the thread guide 7. Since the thread guide positioning accuracy requirements are very high for cross-wound bobbins, and even higher for windings according to any desired lap laws, the dynamic behavior of the traversing element 8 would noticeably limit the traversing speed and hence the winding speed.

By virtue of the described mounting of the motor 11 and the drive wheel 12 on the bracket 20, which is resilient relative to the guide pulleys 9 and 10, the drive wheel 12 acts upon the traversing element 8 like a pre-loading member which presses laterally against the traversing element and compensates for tension variations of the traversing element 8. Since each strand of the traversing element 8 is conveyed from the thread guide 7 to the drive wheel 12, the resilient pre-loading element acts simultaneously upon both strands of the traversing element 8 and therefore prevents both slackening and over-tightening of the stands during the acceleration and deceleration.

At the reversal points, acceleration rates of up to 300 g have been shown by tests conducted on bobbin winding systems utilizing the winding apparatus 4 of the present invention. With an appropriate sensor 13, thread guide positioning accuracies have been shown to be within the range of 0.2 to 0.3 mm for bobbins 30 to 45 cm in length.

As shown in FIG. 3, the bracket 20 at its second transverse edge 28, i.e, the left edge in FIG. 3, has a lug-like projection 23. Associated with projection 23 is a notch 24 disposed at the opposite inside edge of the edge region 19 of the base plate 16. The projection 23 and the notch 24 serve as aids for adjusting the initial tension of the traversing element 8. In the initial state of the base plate 16, in which the traversing element 8 is not yet mounted or pre-loaded, the projection 23 is displaced slightly downwards relative to the notch 24 such that the projection 23 does not lie symmetrically with respect to the notch 24. The initial tension of the traversing element 8 is then adjusted so that the projection 23 lies symmetrically relative to the notch 24.

Projection 23 and notch 24 therefore indicate the position of the bracket 20 in the pre-loaded state of the traversing element 8. Although other markings can be used, experience in the textile industry has shown that the markings formed by projection 23 and notch 24 are most suitable for adjusting the initial tension of the traversing element 8.

I claim:

1. An apparatus for winding a thread onto a bobbin having a traversing element susceptible to tension variations, comprising:

(a) a thread guide connected to said traversing element;

(b) a drive wheel connected to said traversing element, said drive wheel for imparting a force to said traversing element along a longitudinal direction of said bobbin and for positioning said traversing element and said thread guide along said longitudinal direction of said bobbin, and further wherein said drive wheel is arranged to function as a pre-loading element for minimizing tension variations induced by slackening and over-tightening of said traversing element during operation of said apparatus;

(c) a drive motor connected to and in driving arrangement with said drive wheel; and (d) a plurality of guiding elements for guiding, in conjunction with said drive wheel, said traversing element and said thread guide along said longitudinal direction of said bobbin.

2. The apparatus according to claim 1, wherein said traversing element, selected from the group consisting of a cable, a string and a belt, comprises end portions which are wrapped around said drive wheel within a groove formed thereon, said groove being aligned parallel to said traversing element, and further wherein said drive wheel is spring-mounted transversely to said traversing element, and wherein said guiding elements are mounted on a carrier in a fixed manner.

3. The apparatus according to claim 2, further comprising a base plate connected to said carrier for supporting said drive wheel, said base plate comprising:

(a) a bracket;

(b) bending structures for supporting said bracket, said bracket having a first transverse edge supported by said bending structures, and a second transverse edge opposite said first transverse edge suspended free of said base plate; and (c) an outer U-shaped recess and an inner U-shaped recess for separating said bending structures from said base plate, and wherein said inner and outer U-shaped recesses face each other, said bending structures extending between longitudinal limbs formed by said U-shaped recesses and from said bracket to said base plate.

4. The apparatus according to claim 3, wherein the motor is fastened to said bracket, and said bracket acts as a cooling surface for said motor.

5. The apparatus according to claim 3, wherein said bracket is inclined at an angle in the direction of the plane of the traversing element relative to the plane of said base plate.

6. The apparatus according to claim 3, further comprising a marking, for adjusting an initial tension of said traversing element, formed by a projection located on said second transverse edge of said bracket and a notch located on an edge region of said base plate opposite to said projection.

7. The apparatus according to claim 1, further comprising a sensor for monitoring the position of said thread guide as it traverses along said longitudinal direction of said bobbin.

8. The apparatus according to claim 7, further comprising:

(a) a rotating member coupled to said thread guide; and (b) a plurality of scan markings on said rotating member for detection by said sensor.

9. The apparatus according to claim 8, wherein said rotating member is said drive wheel.

10. The apparatus according to claim 7, further comprising:

(a) a disc rigidly connected to said drive wheel; and (b) a plurality of scan markings in the form of perforations on said disc for detection by said sensor.

11. An apparatus for winding a thread onto a bobbin having a traversing element susceptible to tension variations, comprising:

(a) a thread guide connected to said traversing element;

(b) a drive wheel connected to said traversing element for imparting a force to said traversing element along a longitudinal direction of said bobbin and for positioning said traversing element and said thread guide along said longitudinal direction of said bobbin;

(c) a drive motor connected to and in driving arrangement with said drive wheel; and (d) a plurality of guiding elements for guiding, in conjunction with said drive wheel, said traversing element and said thread guide along said longitudinal direction of said bobbin; and (e) pre-loading element for minimizing tension variations induced by slackening and over-tightening of said traversing element during operation of said apparatus.

12. The apparatus according to claim 11, wherein said pre-loading element is spring-mounted transversely to said traversing element.

13. The apparatus according to claim 11, further comprising a sensor for monitoring the position of said thread guide as it traverses along said longitudinal direction of said bobbin.

* * * * *